US006688342B2

(12) United States Patent
Lewis

(10) Patent No.: US 6,688,342 B2
(45) Date of Patent: Feb. 10, 2004

(54) FUEL DISPENSER USING INFRARED TECHNOLOGY TO FACILITATE THE COMMUNICATION OF STRUCTURED DATA

(75) Inventor: Tommy W. Lewis, Chesapeake, VA (US)

(73) Assignee: Tokheim Corporation, Fort Wayne, IN (US)

( * ) Notice: Subject to any disclaimer, the term of this patent is extended or adjusted under 35 U.S.C. 154(b) by 0 days.

(21) Appl. No.: 10/081,341

(22) Filed: Feb. 22, 2002

(65) Prior Publication Data

US 2003/0159752 A1 Aug. 28, 2003

(51) Int. Cl.[7] ..... B65B 1/04

(52) U.S. Cl. ..... 141/94; 141/98; 141/231; 340/10.1; 235/384; 235/361; 700/302

(58) Field of Search ..... 141/192, 94, 98, 141/231; 340/10.1; 235/384, 361; 700/302

(56) References Cited

U.S. PATENT DOCUMENTS 4,119,948 A 10/1978 Ward et al.
5,156,198 A * 10/1992 Hall ..... 141/94
5,327,066 A 7/1994 Smith
5,442,344 A 8/1995 Merkle et al.
5,519,527 A 5/1996 Panton
5,742,229 A 4/1998 Smith
5,890,520 A 4/1999 Johnson, Jr.
6,018,293 A 1/2000 Smith
6,024,142 A 2/2000 Bates
6,073,840 A 6/2000 Marion
6,119,944 A 9/2000 Mulla et al.
6,397,903 B1 * 6/2002 Coates et al. ..... 141/94
6,420,961 B1 * 7/2002 Bates et al. ..... 340/10.1
6,446,049 B1 * 9/2002 Janning et al. ..... 705/40

* cited by examiner

*Primary Examiner*—Steven O. Douglas
(74) *Attorney, Agent, or Firm*—Randall J. Knuth

(57) ABSTRACT

An apparatus and method is available for transferring data relating to the functioning of a fuel dispenser between a wireless device and the fuel dispenser. The wireless device activates a sensor on the fuel dispenser which in turn initiates the transfer of data between the wireless device and the fuel dispenser. The wireless device can download data from the fuel dispenser for review as well as modifying the data. If the operator of the wireless device modifies the data, the operator can upload the modified data to the fuel dispenser.

12 Claims, 1 Drawing Sheet

FUEL DISPENSER USING INFRARED TECHNOLOGY TO FACILITATE THE COMMUNICATION OF STRUCTURED DATA

BACKGROUND OF THE INVENTION

1. Field of the Invention

The present invention relates to the use of a wireless device to connect to a fuel dispenser and utilizing the wireless device to review and/or modify the fuel dispenser settings and data relating to the operation and servicing of the fuel dispenser.

2. Description of the Related Art

To program the settings for a fuel dispenser, typically the technician needs to open the fuel dispenser housing. Once the fuel dispenser housing is open, the technician uses a computer with a cable and plugs the cable into the inside of the fuel dispenser so that the technician can use the computer to determine and program the settings for the fuel dispenser. Also, if a technician wants to review the maintenance history or the event log for the fuel dispenser, the technician needs to open the housing of the fuel dispenser to connect the cable from the computer to the inside of the fuel dispenser. One of the problems with opening the fuel dispenser housing to program the settings for the fuel dispenser, review the maintenance history log and the event log, is that fuel cannot be dispensed from the fuel dispenser because the housing is open. Therefore, there is a loss of sales to the fueling station owner, as well as being inconvenient to the customer.

Another problem with programming the settings and/or reviewing the logs for the fuel dispenser while standing outside at the fuel dispenser while utilizing a connection cable between the computer and the fuel dispenser is that the weather could be inclement, which makes it very uncomfortable for the technician utilizing the fuel dispenser. The present invention solves these problems.

SUMMARY OF THE INVENTION

The present invention, in one form thereof, is an apparatus for transferring data relating to the functioning of a fuel dispenser. The apparatus includes a fuel dispenser that contains data. There is a sensor located on the fuel dispenser. Also, a controller is connected to the sensor. There is a wireless device for activating the sensor to initiate the transfer of data with the fuel dispenser.

The present invention, in another form thereof, is a method of transferring data relating to the functioning of a fuel dispenser. The first step of the method is providing a fuel dispenser with a sensor and data. The next step of the method is activating the sensor with a wireless device to initiate a connection between the wireless device and the fuel dispenser.

The third step of the method is utilizing the wireless device to transfer data with the fuel dispenser.

An advantage of the present invention is that the wireless device can configure the settings for the fuel dispenser as well as any changes to the settings at any time in the future while the customer is able to use the fuel dispenser to pump fuel into the customer's vehicle. Also, the wireless device can be used to review and modify both the maintenance log and the event log while the customer uses the fuel dispenser to pump fuel into the customer's vehicle. Being able to configure and modify the settings as well as review and/or modify the maintenance log and event log while the customer pumps fuel into their vehicle prevents the service station owner from losing revenue by having the fuel dispenser opened wherein the customer cannot pump fuel from the fuel dispenser into their vehicle.

Another advantage of the present invention is that by utilizing a wireless device, the configuration settings for a fuel dispenser can be downloaded into the wireless device and the technician utilizing the wireless device can travel to a more comfortable environment to review and/or modify the settings for the fuel dispenser. Once the configuration settings have been modified, the technician can approach the fuel dispenser and upload the new configuration settings into the fuel dispenser.

Also, the technician can download the maintenance log and/or the event log for the fuel dispenser and can review the logs in a more comfortable environment. Furthermore, the technician can modify the logs by downloading the logs, traveling to a more comfortable environment and updating the logs, and then return to the fuel dispenser and upload the modified logs into the fuel dispenser. Being able to configure and modify the configuration settings as well as review and modify the maintenance log and event log from a comfortable environment when there is inclement weather makes the technician's job much more effective and pleasant.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
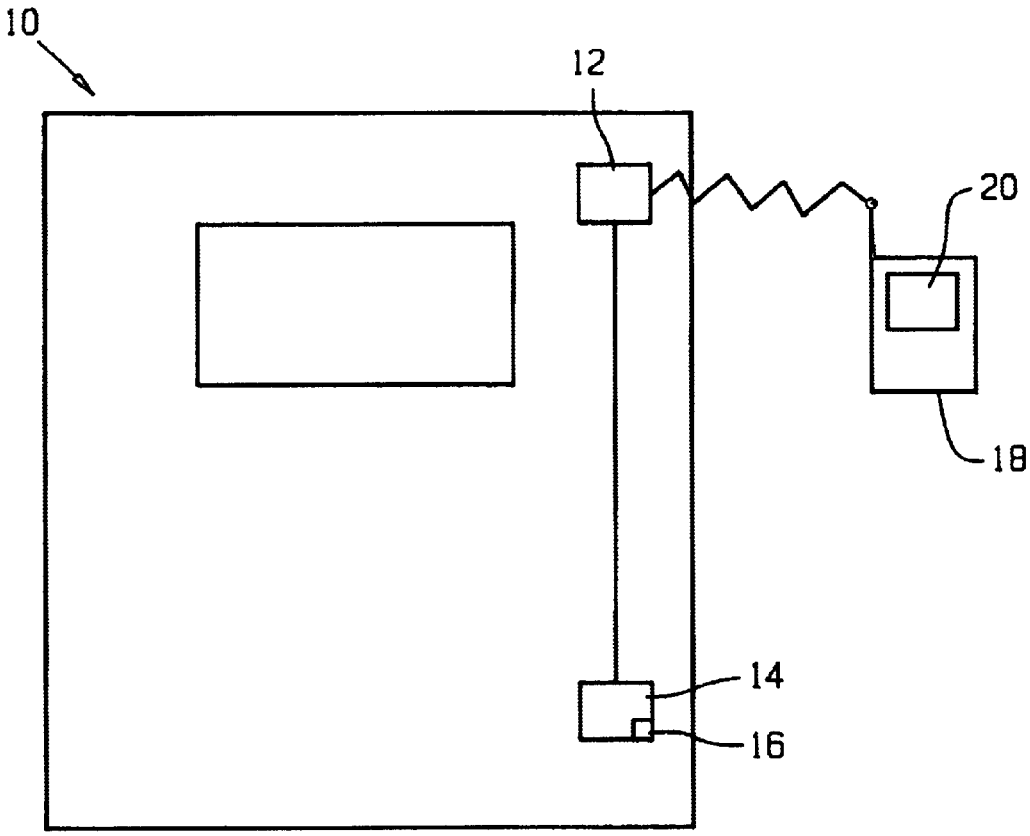
FIG. 1 is a diagrammatic view of one form of the present invention.

In one form of the present invention, as shown in FIG. 1, a fuel dispenser 10 is connected to a sensor 12 and a controller 14. Controller 14 is connected to sensor 12 using a cable or another type of connection device such as a wireless connection device. Controller 14 has a memory 16 which is utilized to store data. A wireless device 18 is utilized for activating sensor 12 to initiate the transfer of data with fuel dispenser 10.

Some of the types of data stored in memory 16 are the configuration data file for fuel dispenser 10, the maintenance log file for fuel dispenser 10 and the event log file for fuel dispenser 10. Other types of data can be stored in memory 16 as well. The configuration data includes, but is not limited to, the types and grades of fuel dispensed by fuel dispenser 10, the location of the types and grades of fuel within fuel dispenser 10, the price for each fuel type and grade in fuel dispenser 10, the prepay slow-flow offset and vapor recovery and leak detection configuration data. The maintenance log contains information relating to any maintenance performed on fuel dispenser 10. The event log contains information relating to any activity that occurs when fuel dispenser 10 is utilized, such as each time a credit card is swiped, each time fuel is dispensed from fuel dispenser 10 as well as any errors that occurred during the fueling transaction. Other activities can be listed in the event log as well.

Each of the configuration file, maintenance log file and the event log file for fuel dispenser 10 can be written using the eXtensible Markup Language (XML). Other languages can be used as well. The XML language is designed to describe data. XML allows the author of the program to define the tags in the document structure for the program. XML is not meant to be confused with the Hypertext Markup Language (HTML). The HTML language is designed to display data. XML and HTML can be used together.

XML is much more flexible than HTML. XML can be used to store any kind of structure data and manipulate that data in order to pass it between different computing systems in which the computing systems would be unable to communicate otherwise. This is an advantage over HTML because HTML depends on a single, inflexible document type. Therefore, XML allows the freedom of being able to manipulate many different types of data to allow for compatibility between different systems utilizing the data.

Sensor 12 detects a beam of light emitted from wireless device 18. The beam of light can be infrared but other types of light can be used as well. Wireless device 18 can be, but is not limited to, a portable computer and a Personal Digital Assistant (PDA). Some examples of PDA's include, but are not limited to, PALM PDA's, the pocket PC, HANDSPRING VISOR PDA's, as well as digital cellular phones. Wireless device 18 has a display 20. Sensor 12, controller 14 and wireless device 18 utilize the Infrared Data Association (IrDA) Standard to wirelessly transfer data between wireless device 18 and controller 14. Wireless communication between wireless device 18, controller 14 and sensor 12 is not limited to infrared light beams and therefore, radio frequency waves, microwaves, receiver signal power communication devices and other data transmission mechanisms and methods can be used.

To utilize the present invention, wireless device 18 sends an infrared beam to sensor 12 located on fuel dispenser 10. Upon sensor 12 detecting the infrared beam from wireless device 18, sensor device 12 activates controller 14. Upon activation of controller 14, controller 14 transfers an image to display 20 located on wireless device 18 with the option regarding which file the operator of wireless device 18 would like to download. The operator utilizes wireless device 18 to select a particular file, causing the file to be downloaded to wireless device 18 for the operator to review and/or modify the file.

An example of the present invention is when the operator utilizing wireless device 18 would like to change the price of the fuel dispensed by fuel dispenser 10. Wireless device 18 activates sensor 12 causing controller 14 to transfer an image to display 20 located on wireless device 18 with the option regarding which file the operator would like to download. The operator utilizing wireless device 18 selects the configuration file from the list of files shown on the image transferred to wireless device display 20 and controller 14 would transfer the configuration file from memory 16 to wireless device 18. The operator utilizing wireless device 18 could sit in a vehicle or the service station to avoid any inclement weather while reviewing and/or modifying the configuration file. If the operator utilizing wireless device 18 wants to modify the configuration file, the operator modifies the configuration file utilizing wireless device 18 and when the modifications to the configuration file are completed, the operator approaches fuel dispenser 10 and utilizes wireless device 18 to select the option to upload the configuration file to memory 16. Controller 14 receives the modified configuration file and replaces the file currently in memory 16 with the modified file. The review and/or modification of other types of data work in the same manner as described in the example above.

Figure 2:
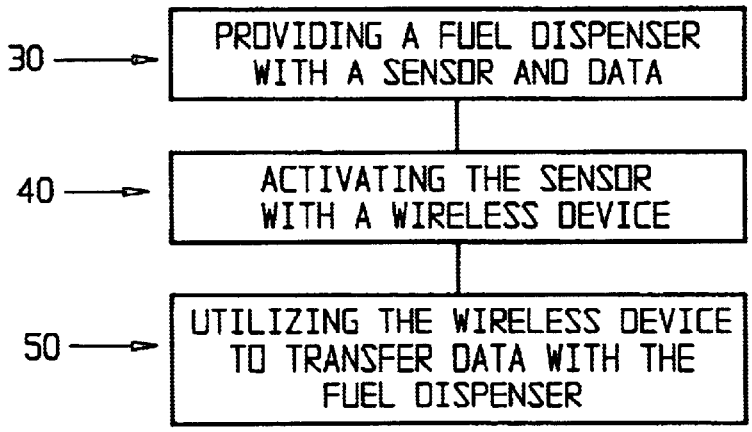
FIG. 2 is a flowchart of one form of the present invention.

The present invention, in another form thereof, is a method of transferring data relating to the functioning of a fuel dispenser as shown in FIG. 2. The first step of the method is providing (30) a fuel dispenser with a sensor and data. The sensor is located on the fuel dispenser. The data is located inside of the fuel dispenser.

The next step of the method is activating (40) the sensor with a wireless device to initiate a connection between the wireless device and the fuel dispenser. The wireless device can be a personal digital assistant or a portable computer. Other wireless devices can be used as well. The wireless device emits a light beam to the sensor. The light beam can be infrared but other types of light beams can also be used. Once the sensor detects the infrared beam, the sensor initiates the transfer of data between the wireless device and the fuel dispenser.

The final step of the method is utilizing (50) the wireless device to transfer data with the fuel dispenser. Once the sensor initiates the transfer of data between the wireless device and the fuel dispenser, the wireless device can download different types of data from the fuel dispenser. Some examples of the data that the wireless device can download would be the configuration file for the fuel dispenser, the maintenance log file for the fuel dispenser and the event log file for the fuel dispenser. This list is for example purposes only and is not meant to be limiting. Once the data is downloaded to the wireless device, the operator of the wireless device can travel to a more convenient setting to review the data and/or modify the data which is especially convenient when the operator of the wireless device is working in inclement weather.

After downloading the data to the wireless device, the operator may decide to modify the data such as adding a new maintenance entry or changing the configuration of the fuel dispenser such as the price of the fuel being dispensed from the fuel dispenser. If modifications to the data have been made, the operator of the wireless device can approach the fuel dispenser and choose the option to upload the modified data to the fuel dispenser. The uploaded data will replace the current data located in the fuel dispenser. The distance needed by the operator of the wireless device to upload and download data to and from the fuel dispenser is dependent on the strength of the infrared beam being sent from the wireless device. The stronger the beam, the farther the operator can be situated from the fuel dispenser when uploading and/or downloading data with the fuel dispenser. Wireless device 18 typically emits a light beam of ten feet without the use of a signal booster.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for transferring data relating to the functioning of a fuel dispenser, comprising:

a fuel dispenser containing data;

a sensor located on said fuel dispenser, said sensor being configured for detecting an activation signal;

a controller connected to said sensor, said controller being configured for being activated upon a detection of the activation signal by said sensor; and a wireless device configured for selectively emitting the activation signal for activating said sensor, said activated controller configured for transferring said data between said wireless device and said controller.

2. The apparatus in claim 1, wherein said wireless device is a personal digital assistant.

3. The apparatus in claim 1, wherein said wireless device is a portable computer.

4. The apparatus in claim 1, wherein said wireless device emits an infrared beam to activate said sensor.

5. The apparatus in claim 1, wherein said data is a configuration file for said fuel dispenser.

6. The apparatus in claim 1, wherein said data is an event log for said fuel dispenser.

7. The apparatus in claim 1, wherein said data is a maintenance log for said fuel dispenser.

8. A method of transferring data relating to the functioning of a fuel dispenser, comprising:

providing a fuel dispenser with a sensor, a controller and data;

activating said sensor with a signal emitted from a wireless device, the activation of said sensor initiating a connection between said wireless device and said controller; and utilizing said wireless device to transfer data with said controller connected therewith.

9. The method in claim 8, wherein said sensor is activated by receiving an infrared beam from said wireless device.

10. The method in claim 8, wherein said data is a configuration file for said fuel dispenser.

11. The method in claim 8, wherein said data is an event log for said fuel dispenser.

12. The method in claim 8, wherein said data is a maintenance log for said fuel dispenser.

* * * * *